US005148853A

United States Patent [19]

Yu et al.

[11] Patent Number: 5,148,853

[45] Date of Patent: * Sep. 22, 1992

[54] METHOD AND APPARATUS FOR CONTROLLING THE HEAT TRANSFER OF LIQUID COOLANT IN CONTINUOUS CASTING

[75] Inventors: Ho Yu, Murrysville; Douglas L. Bruce, Vandergrift; Richard C. Stiffler, Pittsburgh; David D. Leon, Murrysville; Francis J. Glogowski, New Kensington, all of Pa.

[73] Assignee: Aluminum Company of America, Pittsburgh, Pa.

[ * ] Notice: The portion of the term of this patent subsequent to Jan. 29, 2008 has been disclaimed.

[21] Appl. No.: 647,332

[22] Filed: Jan. 28, 1991

Related U.S. Application Data

[63] Continuation-in-part of Ser. No. 366,759, Jun. 14, 1989, Pat. No. 4,987,950.

[51] Int. Cl.[5] ..... B22D 11/124

[52] U.S. Cl. ..... 164/455; 164/487; 164/414

[58] Field of Search ..... 164/455, 486, 487, 150, 164/414

[56] References Cited

U.S. PATENT DOCUMENTS

| | | | |
|---|---|---|---|
| 3,421,939 | 1/1969 | Jacke | 134/1 |
| 3,441,079 | 4/1969 | Bryson | 164/89 |
| 3,646,352 | 2/1972 | Bol et al. | 250/218 |
| 3,680,962 | 8/1972 | Hayakawa | 356/103 |
| 3,886,991 | 6/1975 | Meier et al. | 164/4 |
| 3,933,192 | 1/1976 | Rodenchuk et al. | 164/89 |
| 4,082,565 | 4/1978 | Sjölander | 134/1 |
| 4,166,495 | 9/1979 | Yu | 164/89 |
| 4,187,868 | 2/1980 | Rudolphi | 134/184 |
| 4,216,671 | 8/1980 | Kurland | 73/61 |
| 4,244,749 | 1/1981 | Sachs et al. | 134/1 |
| 4,344,429 | 8/1982 | Gupton et al. | 128/214 |
| 4,540,283 | 9/1985 | Bachalo | 356/336 |
| 4,627,726 | 12/1986 | Turner | 356/336 |
| 4,659,218 | 4/1987 | de Lasa et al. | 356/133 |
| 4,662,749 | 5/1987 | Hatton et al. | 356/336 |
| 4,693,298 | 9/1987 | Wajstaff | 164/486 |
| 4,893,361 | 1/1990 | Burns | 4/255 |
| 4,987,950 | 1/1991 | Yu | 164/455 |

OTHER PUBLICATIONS

"Plant-Implementation of the Airslip Sheet Ingot Process", Greene et al., Light Metals, 1989, pp. 859-865.

*Primary Examiner*—Kuang Y. Lin
*Attorney, Agent, or Firm*—David W. Pearce-Smith

[57] ABSTRACT

A method and apparatus for continuously monitoring the cooling capacity of a liquid coolant containing gas bubbles. The apparatus includes a measuring means for measuring the number density of the bubbles to infer the heat transfer characteristics of the liquid coolant, a control means for varying the amount of gas in the liquid coolant so that the number density is within a predetermined range and an electro-acoustic transducer in fluid contact with the liquid coolant capable of generating waves of sufficient intensity to cause cavitation in the liquid coolant in the area of the measuring means. In a preferred embodiment the electro-acoustic transducer is an ultrasonic horn.

18 Claims, 3 Drawing Sheets

METHOD AND APPARATUS FOR CONTROLLING THE HEAT TRANSFER OF LIQUID COOLANT IN CONTINUOUS CASTING

CROSS REFERENCE TO RELATED APPLICATIONS

This application is a continuation-in-part of copending U.S. Ser. No. 366,759, filed Jun. 14, 1989, now U.S. Pat. No. 4,987,950.

FIELD OF THE INVENTION

The present invention relates to methods and apparatus for controlling the heat transfer characteristics of a liquid coolant containing gas bubbles. More particularly, the method and apparatus of the present invention relate to monitoring and retarding the withdrawal of heat from the surface of a continuously cast ingot by means of a liquid coolant containing gas bubbles.

BACKGROUND ART

Traditionally, continuous casting of light metal ingot has followed the practice of introducing molten metal into one end of an open-ended mold and withdrawing a solid or partially solidified ingot from the opposite end. Typically, the casting mold is relatively short in the axial direction and is hollow or otherwise adapted to receive a liquid cooling medium, such as water, which chills and solidifies the ingot meniscus. The water is then discharged from the mold and continues to chill the ingot as it contacts the ingot surface. Molds are preferably constructed of aluminum but may also be copper, bronze or another material which exhibits high thermal conductivity.

U.S. Pat. No. 4,166,495 issued to Yu discloses an ingot casting method for controlling the withdrawal of heat from the surface of a cooling ingot including mixing a gas, such as $CO_2$, with the liquid coolant, typically water, before the liquid coolant is applied to the ingot surface. When the gas containing liquid coolant is applied to the mold during the initial stages of casting, the gas mixed in the liquid coolant acts to retard the rate of heat extraction of the liquid coolant. When the amount of gas mixed with the liquid coolant is reduced, the rate of heat extraction by the mold is increased. The increased rate of heat extraction is used on subsequent portions of the emerging ingot length.

The method of U.S. Pat. No. 4,166,495 is a commercially successful method of retarding the cooling effect of the liquid coolant and has come to be known in the aluminum industry as the Alcoa 729 process. A preferred coolant for the process is water and one preferred gas is $CO_2$. Other gases which are substantially insoluble in water, such as for example air, may also be used in practicing the method of U.S. Pat. No. 4,166,495.

U.S. Pat. No. 4,693,298 issued to Wagstaff discloses a means an technique for casting metals at a controlled direct cooling rate. The method of U.S. Pat. No. 4,693,298 involves mixing liquid coolant and a gas which is substantially insoluble in the liquid coolant by discharging the gas through jets. The jets release the gas in the flowing liquid coolant as a mass of bubbles that tend to remain discrete and undissolved in the coolant as the coolant on the surface of the ingot.

Although the Alcoa 729 process is economical and effective, it is improvable. The amount of gas mixed with the liquid coolant for the best results in the process can vary with changes in temperature, mixing pressure, and water quality and adjustments are appropriate for the best results. The ability of the gas to retard the heat of extraction of the liquid coolant is determined by the volatility of the liquid, which depends on the concentration of gas mixed in the liquid coolant, the temperature of the liquid coolant, the velocity of coolant flow and the coolant quality of the liquid coolant. The term "quality" as used herein means the chemistry of the liquid coolant and it includes properties such as pH, alkalinity, dissolved and suspended solids, surface tension and ionic species.

In copending U.S. Ser. No. 366,759, filed Jun. 14, 1989, now U.S. Pat. No. 4,987,950 applicant has disclosed a method for continuously monitoring the cooling capacity of a coolant containing bubbles. In one embodiment, the method comprises the steps of: (a) detecting the number density of bubbles within a predetermined size range and (b) comparing the number density to a predetermined number and if necessary varying the amount of gas that is being mixed with the liquid coolant so that the number density obtained is within said predetermined range. In a preferred embodiment, a laser is used to detect the relative number density of the bubbles in water that fall within a predetermined size range. The detection is accomplished by focusing the laser on a device which detects the scattering of laser light by the bubbles.

The method of copending U.S. Ser. No. 366,759 is quite useful in monitoring and controlling the heat capacity of the liquid medium in commercial plants. The method has been found to work at a desirable level even though the coolant quality and temperature may vary. However, it has been found that long term instrument reliability is affected by fouling of the of the light sampling system due to a build-up of slime, dirt, corrosion products and other dissolved and suspended debris on windows which are used to isolate the laser and sensing device from the water. The resulting accumulation of material deleteriously affects the sensitivity of the sensing device and can lead to inaccurate measurements. Cleaning is accomplished by partially dismantling the bubble detector. This represents a significant cost in maintenance and down time.

Accordingly, it would be advantageous to provide an economical and effective method of monitoring and controlling the cooling effect of the liquid medium at a desirable level that does not require disruptive maintenance.

The primary object of the present invention is to provide a method and apparatus for removing deposits on an optical cell used for monitoring the cooling effect of a first liquid containing bubbles or particles of a second liquid.

Another object of the present invention is to provide a method and apparatus that can be readily added to existing casting facilities which permits the in-situ cleaning of window used in the process of monitoring the rate of heat extraction from a liquid coolant in which gas has been mixed to regulate the cooling rate of the coolant when it is used to cool the surface of a continuously cast ingot.

Still another object of the present invention is to provide a method and apparatus that can be readily added to existing casting facilities which will apply ultrasonic energy to windows used in monitoring and- /or controlling the cooling capacity of a liquid coolant containing gas bubbles.

These and other objects and advantages of the present invention will be more fully understood and appreciated with reference to the following description.

DISCLOSURE OF THE INVENTION

A system for monitoring the relative density, or characteristics related thereto, of a first fluid suspended as particles or bubbles in a second fluid to provide a fluid monitor wherein one of the fluids is liquid and the other being gas. The system comprising (a) a conduit for passing the fluid mixture; (b) one or more light passing surfaces in contact with the fluid mixture in the conduit; (c) a means to transmit light into the fluid mixture; (d) a light sensor arranged to receive light emitted from the fluid mixture, the light transmitting means or light sensor, or both being arranged in cooperation with the light passing surface(s) for passing light into and receiving light emitted from the fluid mixture; and (e) means for passing wave energy to the light passing surfaces to clean the surfaces thereof in contact with the fluid mixture.

A second embodiment of the invention is a method for continuously casting metal ingots using a liquid coolant which includes casting molten metal into an open-ended mold used to form an ingot emerging therefrom, providing a liquid coolant, mixing a gas with the coolant liquid so that the liquid contains gas bubbles, using a light source and light sensor to detect the relative number density of the bubbles from the scattering of light, comparing the relative number density to a reference range, varying the relative amount of gas that is being mixed with the liquid when the relative number density is outside the reference range to bring the relative density within the reference range, and applying the liquid coolant to said ingot emerging from the mold to effect at least partial solidification of the molten metal. The method according to the present invention comprises generating waves of sufficient frequency and intensity to remove debris from the light transmitting surface in contact with the liquid.

Another aspect of the present invention is an apparatus for continuously monitoring the cooling capacity of a liquid coolant containing gas bubbles, the apparatus includes: (a) a measuring means for measuring the number density of the bubbles to infer the heat transfer characteristics of the liquid coolant; (b) a control means for varying the amount of gas in the liquid coolant so that the number density is within a predetermined range and (c) an electro-acoustic transducer in fluid contact with the liquid coolant capable of generating ultrasonic waves of appropriate intensity and frequency to cause cavitation in the liquid coolant in the area of the measuring means.

Still another aspect of the present invention is an apparatus for casting a melt into an ingot: (a) a mold for holding a reservoir of melt; (b) an application means for applying liquid cooling medium to the mold to effectuate at least partial solidification of the molten metal therein, the liquid cooling medium containing a gas which forms bubbles which act to retard the rate of heat extraction from the ingot; (c) a sensing means for sensing the number density of bubbles within a predetermined size range and (d) a means for comparing the number density to a predetermined number and if necessary varying the amount of gas that is being mixed with the liquid coolant so that the number density obtained is within said predetermined range; (e) a control means for varying the amount of gas mixed with the liquid cooling medium to bring the number density the liquid cooling medium within a predetermined range and (f) an electro-acoustic transducer in fluid contact with the liquid coolant capable of generating ultrasonic waves of sufficient intensity to cause cavitation in the liquid coolant in the area of the measuring means.

BRIEF DESCRIPTION OF THE DRAWINGS

Other features of the present invention will be further described or rendered obvious in the following related description of the preferred embodiment which is to be considered together with the accompanying drawings, wherein like numbers refer to like parts and further wherein.

DESCRIPTION OF THE PREFERRED EMBODIMENTS

The term "ultrasonic" is used herein to refer to frequencies that are higher than those that are audible to human hearing. "Ultrasonic frequency" is considered to be a frequency in the range of 18 to 108 kHz.

Figure 1:
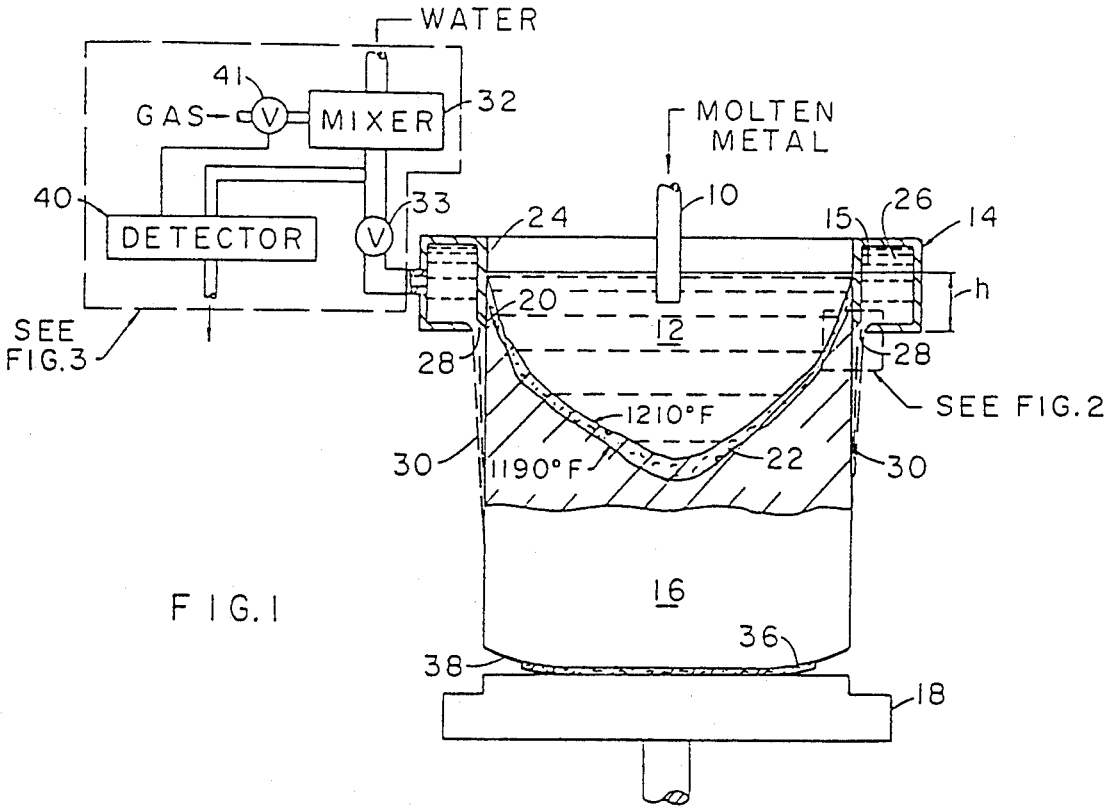
FIG. 1 is a view in vertical section showing the apparatus used in practicing the invention disclosed in copending U.S. Ser. No. 366,759.

Referring first to FIG. 1, there is illustrated a continuous casting apparatus used in practicing the invention disclosed in copending U.S. Ser. No. 366,759. Copending U.S. Ser. No. 366,759 is an improvement of the invention disclosed in U.S. Pat. No. 4,166,495. The content of copending U.S. Ser. No. 366,759 and U.S. Pat. No. 4,166,495 is included herein by reference.

The apparatus shown in FIG. 1 generally includes a pouring spout 10 for molten metal 12, a casting mold 14 generally defining the transverse dimensions of the ingot 16 being cast. The casting mold may be any type of casting mold which is known in the art, including a mold used for electromagnetic casting. The apparatus of FIG. 1 also includes a vertically movable bottom block 18 which closes the lower end of the mold 14 at the beginning of the casting operation and by its descent determines the rate at which the ingot 16 is advanced from the mold 14.

In order to insure that the continuous casting operation is understood, a few definitions should be provided at the outset. Metal "head" is defined as distance from the free surface of the molten metal in the casting basin to the bottom of mold 14. Head is illustrated in FIG. 1 by dimension "h". "Crater" is the term used to define the molten metal pool which exhibits an inverted, generally wedge-shaped configuration from the meniscus of the molten metal level in mold 14 to a location some distance from the exit end of mold 14, which is centrally located in ingot 16. Although the cross-sectional crater profile is often illustrated as a solid line separating molten metal from solid metal, it will be understood by those skilled in the art that there is a mushy zone 22 where the metal is not fully solid yet not really liquid separating the molten and solid phases.

Returning again to FIG. 1, molten metal 12 may be transferred to the casting unit directly from a furnace or from a melting crucible. Molten metal 12 is poured through pouring spout 10 or the like into mold 14 having its bottom closed by bottom block 18. Flow control devices (not shown) may be provided to minimize cascading and turbulent metal flow and to insure even molten metal distribution.

Mold 14 is a conventional direct chill casting apparatus and may be internally cooled, usually with a liquid cooling medium such as water. Mold 14 is typically constructed of a material having high thermal conductivity, such as aluminum or copper, to insure that the coolant temperature is transferred as efficiently as possible through the inner mold wall 24 to the metal to effect solidification.

The coolant 15 used for direct cooling in the continuous casting unit illustrated in FIG. 1 is typically water. Other fluids may be used, however water is preferred because of its availability, cost and heat removal capacity. The water fills passageway 26 and is fed through the multiple orifices 28 which are spaced around mold 14 and extend through the lower inside corner 20 of the mold. Orifices 28 are constructed and spaced such that the cooling water fed therethrough is directed against the exterior surfaces of ingot 16 forming a uniform blanket of water 30 about the emerging portion of the ingot.

As stated above, a preferred gas which is used in the process described in U.S. Pat. No. 4,166,495, is carbon dioxide ($CO_2$). Carbon dioxide is soluble in water especially under pressure. The dissolved carbon dioxide concentration of water 15 is measured in terms of volumes. At atmospheric pressure and at a temperature of 60° F. (16° C.), a given volume of water will dissolve an equal volume of carbon dioxide and is said to contain one volume of dissolved carbon dioxide. Solubility of carbon dioxide in water increases with increases in pressure. As the pressure of the carbon dioxide is decreased, its solubility is decreased. However at the water temperature used in casting, the solubility of carbon dioxide in water also decreases as the temperature of the water increases. The dissolving of $CO_2$ may readily take place in an absorption or mixing device 32, such as a pump or a static mixer. The gas is dissolved into the ingot cooling water prior to the feeding of the water through valve 33 onto the exterior ingot surfaces In a single supply water system, as illustrated in FIG. 1, it is practical to dissolve the gas in the water, before the water is fed to the mold. Preferably at least 50% of the gas mixed with the coolant is dissolved with the coolant.

Figure 2:
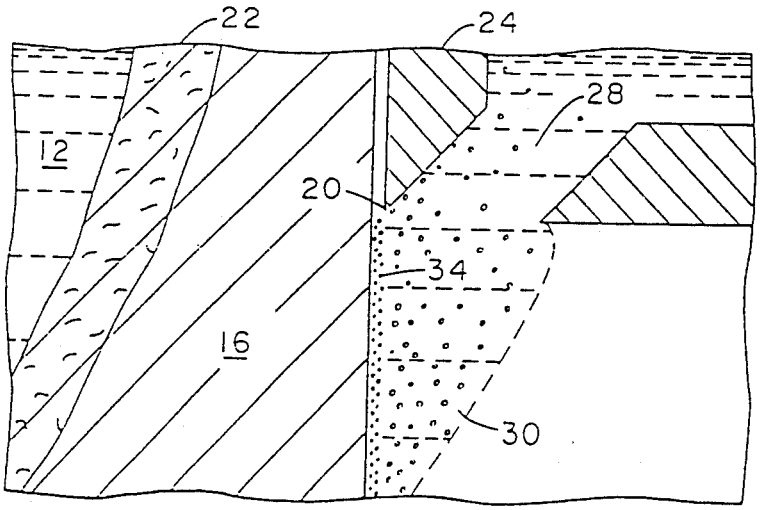
FIG. 2 is an enlarged cross-sectional view of portion II of FIG. 1.

As mentioned above, the dissolved gas comes out of solution when pressure drops. As illustrated in FIG. 2, which is an enlarged view of Section II of FIG. 1, a portion of the released gas adheres to the exterior surface of the emerging ingot 16 forming a uniform, yet effective, insulation layer 34 which acts to retard the heat extraction otherwise effectuated by the cooling medium. It has been found that the use of sufficient dissolved carbon dioxide in cooling water to provide a continuous gaseous blanket on the ingot surface results in the formation of an insulation layer which can significantly reduce the normal heat transfer rate. Therefore, the initial stages of the vertical continuous casting operation results in a reduction of ingot butt curl and butt swell. To achieve better reductions in ingot butt swell, an insulation pad 36, typically a ceramic fiber blanket or the like, may be utilized as a cover over, preferably, at least 50% to 60% of the bottom face 38 of ingot 16 to minimize heat loss through the bottom block 18.

It is understood by those skilled in the art that insulation layer 34, shown in the enlarged cross-sectional view of FIG. 2, is constantly renewing. The volume of water being fed onto the ingot surfaces is too great to expect the insulation layer to be unaffected by flow rate. Therefore, it is expected that insulation layer of gas 34 is constantly being eroded, yet substantially simultaneously it is being replaced by the released gas contained in the incoming water. The gas particles tend to follow the path of least resistance and, therefore, a larger portion of the gas particles are automatically washed out of the system. However, new gas particles tend to adhere to a surface; therefore, there is always a uniform layer 34 of gas particles on the ingot surface as long as the gas is being dissolved in the coolant.

Minimizing ingot butt deformities requires retarding the cooling effect of the direct chill coolant during the initial stages of the continuous casting operation. This can be accomplished, for example, by dissolving from 10 to 30 SCFM (0.0046 to 0.0142 cubic meters per second) of carbon dioxide into the cooling water depending on the cooling water flow rate. Usually, after the initial few inches of an ingot have emerged from the mold, the insulating layer of gas 34 can be reduced or eliminated. To reduce or remove the insulating layer 34, all that is required is to reduce or shut off the gas flow. Preferably, such shut-off is gradual so as to progressively increase the rate of heat extraction provided by the coolant and thereby eliminate extreme imbalance of the overall cooling process.

As described in "A Process to Reduce Ingot Butt Curl and Swell", Ho Yu, *Journal of Metals,* November 1980, the prior art apparatus of FIG. 1 retards ingot cooling by promoting film boiling of the carbonated cooling water when it comes into contact with the ingot surface. The total pressure of the boiling water containing dissolved carbon dioxide, which is greater than atmospheric pressure, is equal to the water-vapor pressure plus dissolved carbon dioxide partial pressure. The dissolved carbon dioxide, therefore, lowers the boiling point of the ingot cooling water and promotes film boiling of the water when it is released from the ingot water.

Figure 3:
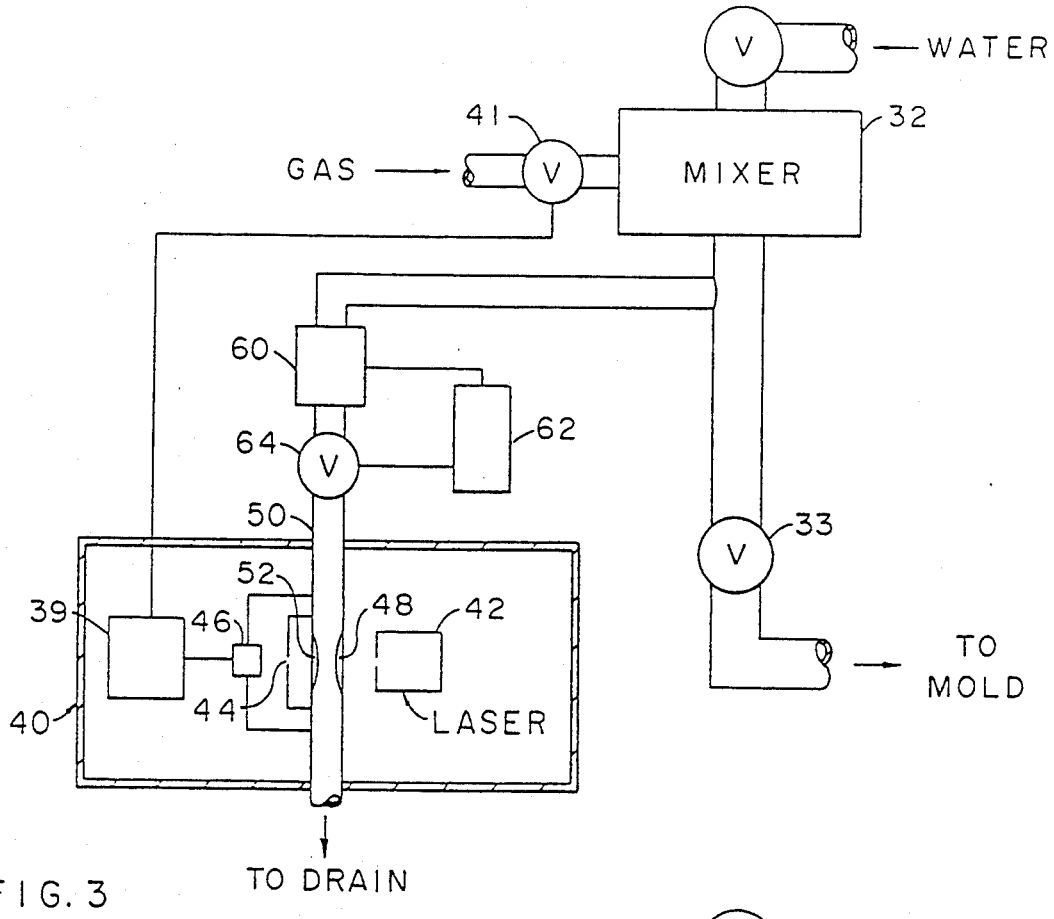
FIG. 3 is an enlarged cross-sectional view of portion III of FIG. 1.

Turning next to FIG. 3, there is illustrated an enlarged cross-sectional view of portion III of FIG. 1 which is shown in copending U.S. Ser. No. 366,759. As is more clearly seen in FIG. 3, flow meter 60, controller 62 and control valve 64 are positioned and adjusted to insure that the residence time of the water passing therebetween is substantially constant. Bubble detector 40 is not only designed to detect the presence of bubbles within coolant 15 but it is also designed to detect the presence of bubbles within a predetermined size range. Furthermore, bubble detector 40 will detect the relative density or the number density of these bubbles.

The terms "number density" and "relative density" are used interchangeably herein and they both refer to the concentration of bubbles in a volume of liquid. It is not necessary for bubble detector 40 to actually count the number of bubbles to determine the number density. The number density or relative bubble density of the fluid will be determined by comparing the output from bubble detector 40 to a reference. Both the output from detector 40 and the reference are representative of bubble density levels but neither actually needs to be an actual bubble count.

Thus, bubble detector 40 discriminates between bubbles which are useful for a given application and other bubbles which are less useful. For example, in the method of U.S. Pat. No. 4,166,495, the most useful bubbles are the smaller bubbles which contribute more to insulation layer 34 (shown in FIG. 2) than bubbles which are excessively large.

Bubble detector 40 comprises a light source 42, an aperture 44 and a sensor 46. The size and location of bubble detector 40 is such that it can continuously monitor the amount of small gas bubbles and evolving micron sized gas bubbles suspended in the coolant prior to the coolant contacting the surface of ingot 16. The term "suspended" is used herein to mean the bubbles are supported by the liquid coolant but are not dissolved in it. Bubble detector 40 is connected to a microprocessor 39 which continuously calculates the optimum flow rate for the gas entering mixer 32. Microprocessor 39 performs this task by adjusting valve 41.

Light source 42 is positioned near a window 48 in conduit 50. The term "window" is used herein to mean a surface through which light can penetrate due to the low absorption or dissipation of electromagnetic energy. Because of the scattering and low intensity of incandescent light, the preferred light source is laser light. Conduit 50 also contains a second window 52. Windows 48 and 52 are both transparent to the light emitting from light source 42. Windows 48 and 52 may be made of, for example, glass and are affixed to conduit 50 to prevent the loss of fluid.

Figure 4:
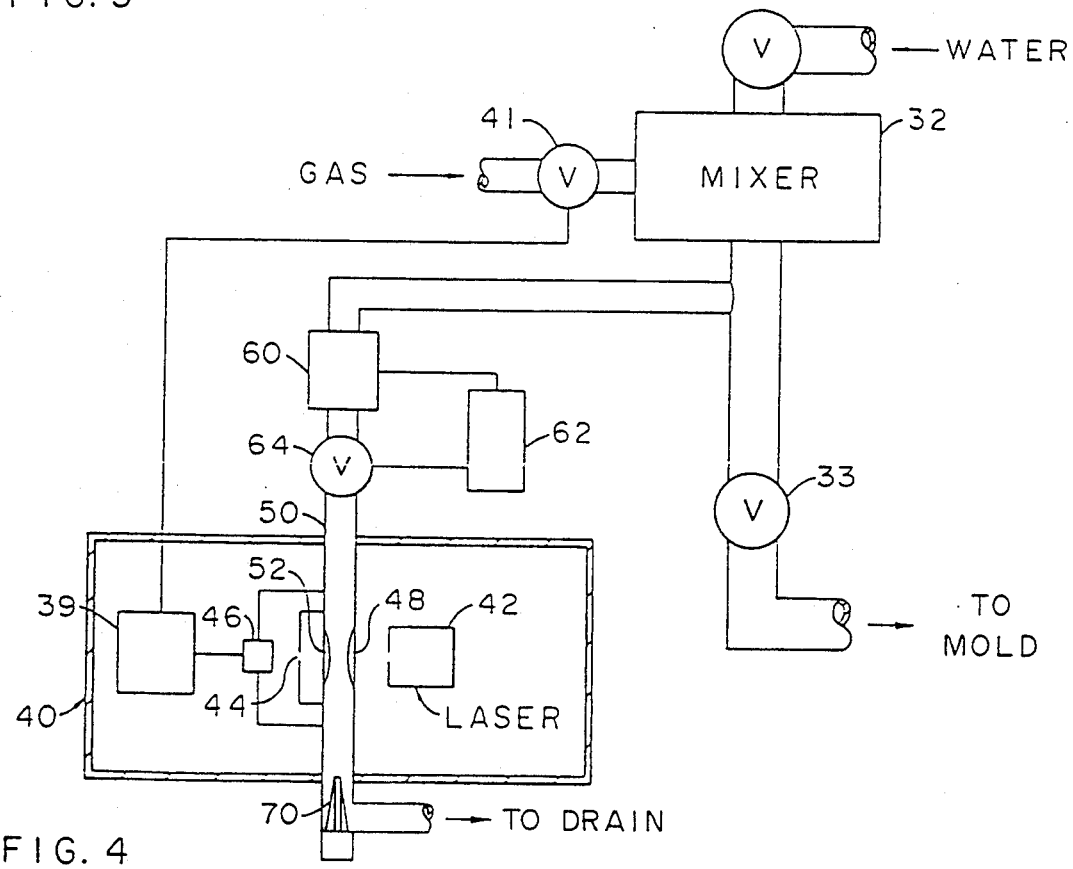
FIG. 4 is an enlarged cross-sectional view of the same area as FIG. 3 illustrating the present invention.

Aperture 44 is positioned near sensor 46 and window 52, in such a manner that light emitter from light source 42 must pass through window 52 and aperture 44 before reaching sensor 46. Aperture 44 can be positioned adjacent to window 52 and outside conduit 50, as shown in FIG. 4, or it can be positioned within conduit 50.

Sensor 46 is a photoconductive cell or photoelectric conversion element such as, for example, CdS or the like which is fixed to conduit 50. It is well known that the electric resistance value of the photoconductive cell will change in accordance with the intensity of light incident on the photoconductive cell. The photoconductive cell in sensor 46 is connected to microprocessor 39. The change in resistance in the photoconductive cell provides a continuous signal to microprocessor 39. The signal strength is related to the number density of the bubbles that are within a reference size range. Microprocessor 39 continuously compares the signal from sensor 46 to a reference signal or range of signals.

On the basis of this comparison, microprocessor 39 sends a command signal to a control (not shown) on valve 41 to either open or close the valve. The command will cause the valve to change by one increment. Since microprocessor 39 is continuously comparing the signal from sensor 46 to a reference signal, the opening in valve 41 will be changed by successive increments until the gas flow rate and thus the electrical input resistance from sensor 46 is within the reference range.

In addition, if the water contains a gas under pressure, valve 64 will act to release the pressure in the system to a lower controlled pressure so that the bubble size and bubble density of the bubbles being detected is representative of the bubble size and bubble density of the water that is being applied to the surface of the emerging ingot. In this regard, the size and number density of the bubbles in conduit 50 need not be of the exact size and number as those being applied to the surface of the ingot. However, the bubble detector will need to be properly calibrated so that the microprocessor will be able to correctly determine if the generated input signal is too large or too small so that valve 41 can be adjusted accordingly.

It is to be noted that the signal from sensor 46 to microprocessor 39 is instantaneous. Therefore, microprocessor 39 can continuously monitor changes in the electrical resistance from the photoconductive cell due to the presence of small bubbles in the water. From this continuous monitoring, microprocessor 39 is continuously calculating whether the concentration of small bubble in the liquid coolant is in a range that has be determined to produce the correct heat transfer of the water stream as it is to be used for cooling the surface of ingot 16. Microprocessor 39 can instantaneously calculate the optimum flow rate for gas entering mixer 32 and open or close valve 41 to bring the electrical resistance input from sensor 46, and thus the small bubble concentration, to within a reference range. The reference operating range of electrical resistance for sensor 46 may be programed into microprocessor 39 with reference to the size of the ingot, the composition of the ingot which is being cast and the stage of casting, the position of the bottom block or the elapsed time in the casting operation.

Despite all of the benefits of the process disclosed in copending U.S. Ser. No. 366,759, there is room for improving the stability of the process. As stated above, for the system to work the bubble detector needs to be properly calibrated so that the microprocessor will be able to correctly determine if the generated input signal is too large or too small so that valve 41 can be adjusted accordingly. It has been found that long term instrument reliability is affected by the gradual fouling of windows 48 and 52 due to adherence of slime, dirt, rust, calcium and other debris. The resulting accumulation of material reduces the intensity of incident light on sensor 46 and thus deleteriously affects the calibration of the bubble detector and results in inaccurate measurements or measurement failure.

The method described above, provides no means for the in-situ cleaning of the interior sides of windows 48 and 52. Chemical treatments which react with the adhering material can be used to remove the fouling. However, chemical treatments require knowledge of the chemical composition of the fouling material. In addition, chemical treatments introduce unwanted chemicals into the environment.

Turning next to FIG. 4, there is illustrated an apparatus of the present invention. The apparatus of FIG. 4 is identical to that of FIG. 3 with the exception that an ultrasonic horn 70 is positioned inside conduit 50 downstream from bubble detector 40. Ultrasonic horn 70 is positioned near windows 48 and 52 so that the windows can receive the maximum transmission of ultrasonic energy and simultaneously minimize extraneous vibration to the system. It is not known how far down stream an ultrasonic device can be placed before it loses its effectiveness. However, it is believed that it is best if the distance between the window and the horn tip is less than 1 foot. Ultrasonic horn 70 is an electro-acoustic transducer capable of generating ultrasonics of appropriate wave energy to cause cavitation in the liquid coolant and effect cleaning in the area of windows 48 and 52, particularly their surfaces contacting the liquid in conduit 50. The term "wave energy" is used herein to mean waves of fluid having sufficient frequency and intensity to effect cleaning of the windows.

Ultrasonic cleaning devices are known in the art. See for example U.S. Pat. Nos. 4,893,361; 3,421,939; 4,082,565; 4,187,868; 4,216,671; and 4,244,749. Preferably the ultrasonic transducers are either piezoelectric transducers or magnetorestrictive transducers. Suitable transducer materials include lithium nisbate, lithium tantalate, barium sodium nisbate, bismuth germenate, lead titanate zirconate, and barium titante. Branon's Model Number 922RA has be found to work effectively in practicing the present invention.

In operation, ultrasonic horn can be activated automatically or manually based on visual clues of cleanliness. If the ultrasonic horn is to be automatically activated it has been found useful to devise a system in which the windows are cleaned before carbon dioxide is added to the cooling medium. This is accomplished by comparing the amount of light transmitted from light source 42 through windows 48 and 52 to sensor 46 to a predetermined baseline level established when windows 48 and 52 were known to be clean.

If the light transmitted from light source 42 through windows 48 and 52 and aperture 44 hit sensor 46 and cause microprocessor to register a level of electrical resistance input below a predetermined value, a command signal will be sent to energize ultrasonic horn 70. A timing means can be used to energize the ultrasonic horn for a short period of time, i.e. for 15–90 seconds. Short bursts of ultrasonic energy are preferred to avoid melting of plastic materials due to frictional heat. In this regard, it may be desirable to install a means for monitoring the temperature of ultrasonic horn 70.

Afterwards, a new value of light transmission can then be established and if necessary an additional command signal will be sent to a control to energizing ultrasonic horn 70 so as to further clean windows 48 and 52. This process is repeated until the intensity of light registering on sensor 46 is above at or above a predetermine baseline value. The water passing through conduit 50 will automatically flush the loosened debris away from the windows. In this manner the windows are remotely cleaned prior to casting.

Figure 5:
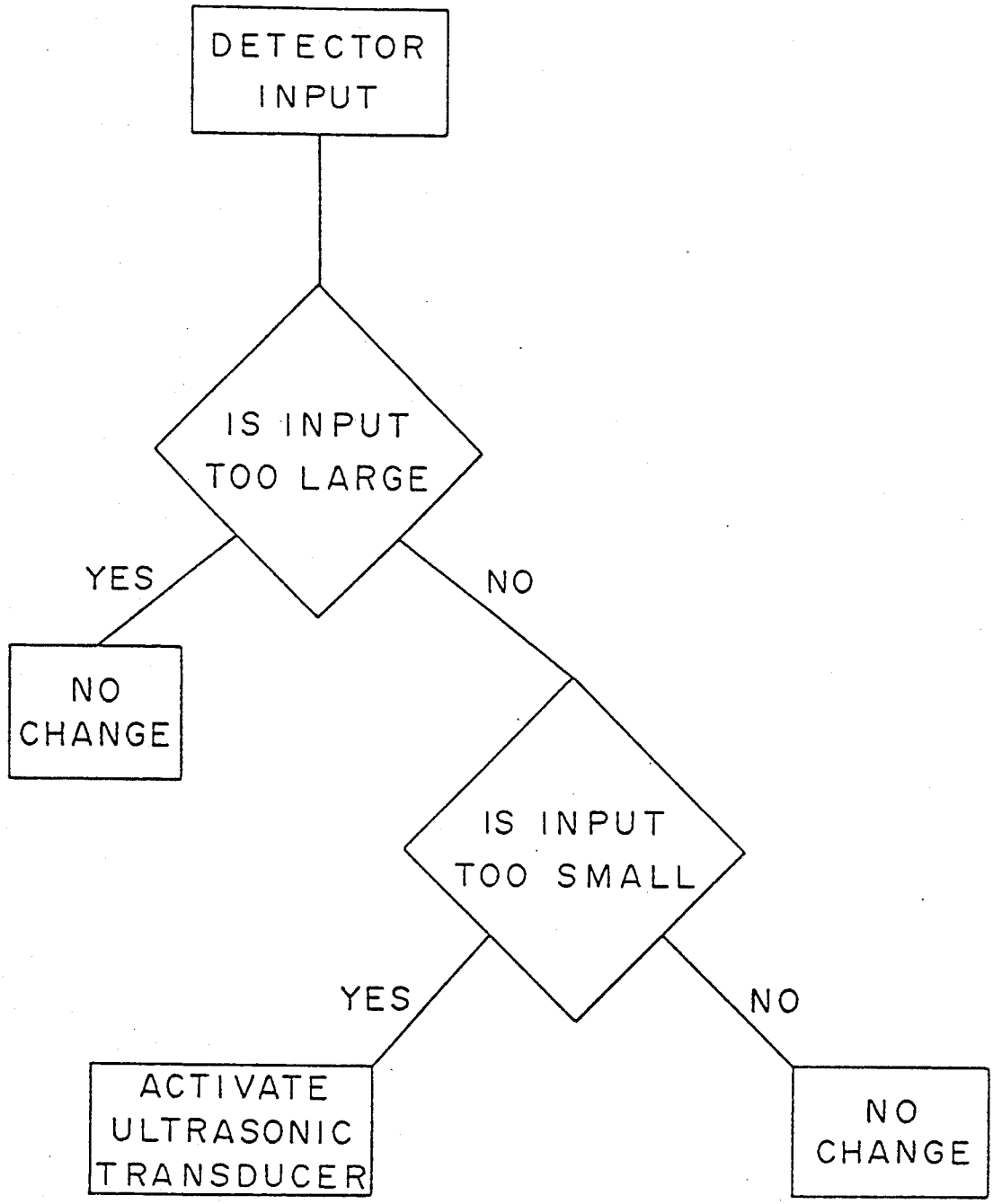
FIG. 5 is a logic and process flow diagram showing decisions of the process in automatically energizing an ultrasonic horn.

FIG. 5 is a logic and process flow diagram showing decisions of the process in automatically energizing ultrasonic horn 70. Essentially the procedure followed in the process include the following steps:

(a) Inquest the sensor signal from the detector into the microprocessor.

(b) Determining if the input signal from the sensor is smaller than a reference value stored in the microprocessor.

(c) If the input signal is smaller than the reference signal stored in the microprocessor, sending a command signal to a control to energizing ultrasonic horn 70. A timing means can be used to energize the ultrasonic horn for a short period of time, i.e. for 15 seconds.

(d) If the input signal is not smaller than the reference signal stored in the microprocessor, send no command to the control to energizing ultrasonic horn 70.

The following examples are offered to illustrate the use of ultrasonic energy to clean optical cells used in an apparatus for continuously monitoring the cooling capacity of a liquid coolant containing gas bubbles.

EXAMPLE 1

The amount of light transmitted from a light source through two windows on the sidewall walls of a conduit containing water was measured using a light sensor of the type shown in FIG. 4. The two windows are known to be clean and were used to establish a baseline level using the sensor. The baseline voltage signal was found to be approximately 7.9 volts.

A second set of windows that are coated with debris on one side are then substituted for the clean windows. The debris laden side of the windows are positioned so as to form part of the interior sidewall of the conduit. The voltage signal for the second set windows was measured and determined to be approximately 6.5 volts.

Five bursts of ultrasonic waves are generated within the conduit in the area near the windows. The term "ultrasonic waves" is used to mean waves whose length correspond to ultrasonic frequencies. An ultrasonic horn which is commercially available as Branon's Model Number 922RA is used to generate the ultrasonic waves. The voltage signal then measured and determined to be approximately 7.4 volts. The second set of windows were then removed from the conduit and found to be essentially clean.

EXAMPLE 2

The procedure of Example 1 is repeated except that the initial value of the second set of windows that are coated with debris is determined to be approximately 1.4 volts.

Three bursts of ultrasonic waves each thirty second in duration are generated within the conduit in the area near the windows. The voltage signal is measured after each burst and determined to be approximately 3.4, 4.0 and 4.1 volts, respectively. Then two bursts of ultrasonic waves each sixty second in duration are generated within the conduit in the area near the windows. The voltage signal is measured after each burst and determined to be approximately 5.3 and 5.7 volts, respectively. A final burst of ultrasonic waves thirty second in duration is generated within the conduit in the area near the windows. The voltage signal is measure and determined to be approximately 6.9 volts. The second set of windows were then removed from the conduit and found to be acceptably cleaned.

Those skilled in the art will recognize that (1) the actual reference value that one uses for the bubble detector (2) the baseline level for the cleanliness of window and (3) the length of time that the ultrasonic horn is activated are all system dependent. Once a predictable time period for build up can be established, a microprocessor and/or timer can be used to automatically remove deposits. In this manner it will not be necessary to employ an inspector to determine when the windows are to be cleaned.

It is contemplated that the apparatus of the present invention need not be used prior to each casting. The need to use the ultrasonic horn will be dependent on the contaminants in the water that is being used as a cooling medium. However, it may be convenient to measure window cleanliness between castings as described above or to just routinely clean the windows for instance at the beginning of each day.

In addition, although the present invention has been described in terms of an ultrasonic horn for generating ultrasonic waves, it is not so limited. Thus, those skilled in the art will recognize that an ultrasonic wave generator such as a piezoelectric device may also be used.

It is contemplated that the electro-acoustic transducer that is used to generate the waves to effect cleaning need not be placed downstream from the windows, it is not critical that it is so placed. The transducer may also be positioned upstream or in such a way that the liquid passes the windows and electro-acoustic transducer simultaneously. In addition, although the invention has been described in terms of placing an electro-acoustic transducer within the conduit containing water that is being used as a cooling medium, it is believed that the ultrasonic wave generator may be resiliently mounted on the outer surface of the windows.

Further it is contemplated that the apparatus of the present invention will be especially valuable in the casting of alloys having a short solidification range. As discussed above, alloys having short solidification are especially sensitive to ingot butt curl.

It is contemplated that the apparatus of the present invention will be valuable in the casting of alloys which are difficult to cast without cracking such as aluminum-lithium alloys and alloys containing zirconium. The present invention has been found useful in casting ingots of Aluminum Association Alloys in the 7XXX and 2XXX series alloys which have a large width to thickness ratio. However, the invention may be practiced on all alloys. Metals suitable for treatment with the present invention include aluminum, magnesium, copper, iron, nickel, cobalt, zinc, and alloys thereof.

It is also contemplated that means other than a light source may be used to detect fouling and, if desired, infer the heat transfer characteristics of the liquid coolant which is used. Thus for example a sonic means can be used to detect fouling. In addition, the light source need not be emitting visible light but can be emitting any electromagnetic radiation that is dissipated or absorbed by the presence of droplets or bubbles in the liquid.

Although the invention has been described in terms of a preferred embodiment in which carbon dioxide gas is dissolved in water, a second preferred gas is air which is entrained in water as a mass of bubbles that tend to remain discrete and undissolved as the water is directed at the surface of an emerging ingot.

Furthermore, although the invention of the present invention has been described in terms of a gas that is mixed in a flowing liquid, the invention is also intended to include a liquid coolant being mixed into a flowing gas. Those skilled in the art will recognize that the bubble detector will then be used to detect droplets of liquid coolant suspended in the gas. The invention may also be used to detect immiscible liquids that cannot be mixed to for a simple liquid phase, such as, for example, oil and water.

Whereas the preferred embodiments of the present invention have been described above in terms of a continuous vertical casting system for purposes of illustration, it will be apparent to those skilled in the art that numerous variations of the details of the casting system, in which the present invention is to be used, may be made without departing from the invention. For example, casting may be done in other known casting methods, such as electromagnetic casting. In addition, the casting may be accomplished in other than vertical casting systems. Thus for example the casting may be performed in the horizontal direction, as described in U.S. Pat. No. 4,474,225, issued to Ho Yu Oct. 2, 1984. In addition, the casting need not be continuous but may be intermittent.

Since changes may be made in the process and apparatus described above without departing from the scope of the invention, it is intended that all matter contained in the above description or shown in the accompanying drawings shall be interpreted as illustrative. The present invention is indicated by the broad general meaning of the terms in which the following claims are attached.

What is claimed is:

1. A system for monitoring the relative density of a first fluid suspended as bubbles in a second fluid wherein one of said fluids is liquid and the other being gas, said system comprising:

(a) a conduit for passing said fluid mixture;

(b) one or more light passing surfaces in contact with said fluid mixture in said conduit;

(c) a means to transmit light into aid fluid mixture;

(d) a light sensor arranged to receive light emitted from said fluid mixture;

(e) a generating means for generating a signal related to the amount of light impinging on said sensor;

(f) a varying means for varying the amount of gas in said liquid in response to said signal; and (g) means for passing wave energy to said light passing surfaces to clean the surfaces thereof in contact with said fluid mixture.

2. The system of claim 1 in which said means to transmit light into said fluid mixture includes:

a light source arranged to pass light through a light passing surface and through at least a portion of said fluid mixture.

3. The system of claim 1 in which said one or more light passing surfaces in contact with said fluid mixture includes:

a first light passing surface for passing light into said fluid mixture; and a second light passing surface for passing light out of said fluid mixture and to said light sensor.

4. The system of claim 1 in which said means for passing wave energy to said light passing surfaces to clean the surfaces thereof in contact with said fluid mixture includes:

an electro-acoustic transducer located downstream from said light source.

5. The system of claim 1 in which said means for passing wave energy to said light passing surfaces to clean the surfaces thereof in contact with said fluid mixture includes:

an ultrasonic transducer operable at a frequency of between 18 and 80 kHz.

6. In a method for continuously casting metal ingots using a liquid coolant which includes casting molten metal into an open-ended mold used to form an ingot emerging therefrom, providing a liquid coolant, mixing a gas with said coolant liquid so that said liquid contains gas bubbles, using a light source and light sensor to detect the relative density of said bubbles from the scattering of light, comparing said density to a reference range, varying the amount of gas that is being mixed with said liquid when said density is outside said reference range to bring said density within said reference range, and applying said liquid coolant to said ingot emerging from said mold to effect at least partial solidification of said molten metal the improvement comprising:

generating waves of sufficient energy to effect cleaning of a light transmitting surface in contact with said liquid.

7. The method of claim 6 in which said step of generating waves includes:

an electro-acoustic transducer downstream from said light source and said light sensor and in fluid contact with said liquid coolant.

8. The method of claim 6 in which said step of generating waves includes:

generating waves prior to casting molten metal into an open-ended mold.

9. The method of claim 6 in which said step of generating waves includes:

an ultrasonic transducer operable at a frequency of between 18 and 80 kHz.

10. The method of claim 6 in which said step of generating waves includes:

energizing an electro-acoustic transducer for about 15–60 seconds.

11. A method for controlling the heat exchange capacity of a first liquid containing droplets of a second liquid or bubbles of a gas, said method comprising the steps of:

(a) detecting the density of said droplets or bubbles;

(b) comparing said density to a reference density;

(c) varying the amount of said second liquid or said gas in said first liquid so that the relative density is within said reference range; and (d) periodically generating waves of sufficient intensity to effect cleaning of light transmitting surfaces in contact with said first liquid.

12. The method of claim 11 in which said step of detecting the relative density of said bubbles includes:

a first liquid of water;

a discontinuance gas phase within said water; and detecting the relative density of said bubbles within said water.

13. The method of claim 12 in which said step of providing discontinuance gas phase within said water includes:

providing carbon dioxide gas as a discontinuance phase within said water.

14. The method of claim 11 in which said of periodically generating waves includes energizing and de-energizing an electro-acoustic transducer to generate ultrasonic waves for of 15–90 seconds.

15. An apparatus for controlling the transfer capacity of a first liquid coolant containing bubbles of a second liquid, said apparatus comprising:

(a) a measuring means for measuring the number density of said bubbles to infer the heat transfer characteristics of liquid coolant;

(b) a control means for varying the amount of said second liquid in said first liquid coolant so as to maintain the number density is within a predetermined range; and (c) an electro-acoustic transducer in fluid contact with said first liquid coolant capable of generating waves of appropriate intensity to effect cleaning in the area of said measuring means.

16. The apparatus of claim 15 in which said electro-acoustic transducer is an ultrasonic transducer operable at a frequency of between 18 and 80 kHz.

17. The apparatus of claim 15 in which said measuring means includes:

a light source;

a first window for separating said light source from said liquid coolant;

a second window for separating a sensor from said liquid coolant; and said sensor positioned to detect light emitted from said light source that has passed through said first and second window and said liquid coolant and measure the number density of the bubbles in said liquid coolant to infer the heat transfer characteristics of said liquid coolant.

18. The apparatus of claim 15 which further includes:

(d) a timing means for energizing and de-energizing said electro-acoustic transducer.

* * * * *

UNITED STATES PATENT AND TRADEMARK OFFICE

CERTIFICATE OF CORRECTION

PATENT NO. : 5,148,853

DATED : September 22, 1992

INVENTOR(S) : Ho Yu, Douglas L. Bruce, Richard C. Stiffler, David D. Leon and Francis J. Glogowski It is certified that error appears in the above-identified patent and that said Letters Patent is hereby corrected as shown below:

| | |
|---|---|
| Col. 14, line 1<br>Claim 14 | After "said", insert --step--. |
| Col. 14, line 5<br>Claim 15 | After "the", insert --heat--. |

Signed and Sealed this

Fourth Day of January, 1994

*Attest:*

*Attesting Officer*

BRUCE LEHMAN

*Commissioner of Patents and Trademarks*